US005526965A

United States Patent [19]

Degenkolbe et al.

[11] Patent Number: 5,526,965

[45] Date of Patent: Jun. 18, 1996

[54] SAFETY DEVICE FOR A BEVERAGE CONTAINER VALVE INSET

[75] Inventors: Horst Degenkolbe, Nörvenich; Detlef Obier, Niederöfflingen; Stefan Busenbach, Betzdorf; Günter Frauenkron, Wesseling, all of Germany

[73] Assignee: D. S. I. Josef Breitwisch & Co. GmbH, Germany

[21] Appl. No.: 495,399

[22] PCT Filed: Jan. 25, 1993

[86] PCT No.: PCT/EP93/00164

§ 371 Date: Jul. 25, 1995

§ 102(e) Date: Jul. 25, 1995

[87] PCT Pub. No.: WO94/16985

PCT Pub. Date: Aug. 4, 1994

[51] Int. Cl.[6] ..... B67D 1/08

[52] U.S. Cl. ..... 222/400.7

[58] Field of Search ..... 222/400.7, 400.8; 137/212, 322; 251/149.6

[56] References Cited

U.S. PATENT DOCUMENTS

| | | | |
|---|---|---|---|
| 3,596,810 | 8/1971 | Taubenheim | 222/400.7 |
| 4,411,287 | 10/1983 | Hyde | 222/400.7 X |
| 4,736,926 | 4/1988 | Fallon et al. | 137/212 X |
| 5,242,092 | 9/1993 | Riis et al. | 222/400.7 |

FOREIGN PATENT DOCUMENTS

| | | | |
|---|---|---|---|
| 493976 | 7/1992 | European Pat. Off. . | |
| 512152 | 11/1992 | European Pat. Off. . | |
| 4204660 | 8/1993 | Germany | 222/400.7 |
| 2188040 | 9/1987 | United Kingdom | 222/400.7 |

*Primary Examiner*—Kevin P. Shaver
*Attorney, Agent, or Firm*—Diller, Ramik & Wight

[57] ABSTRACT

A safety device for a pressurized beverage container, such as a beer keg, is provided with a locking element (15) formed as a double angled piece with an outwardly tang (22), an oblique segment (23) and an inward projecting tang (24). The tank (22) rests in a trapezoidal recess (29) of a base plate (14) of a rise pipe (8) which in turn includes a conical flare (9) between a lower rise pipe portion of a lesser diameter and an upper larger diameter rise pipe portion (10) received in a housing (2, 7) of the safety device. The conical flare (9) is directed away from the projecting tang (24) of the locking element (15) by a distance larger than the normal opening excursion of the rise pipe (8). This structure allows the assembly of the safety device before insertion into a dispensing aperture (45) of a pressurized keg, as well as the withdrawal therefrom absent injury or damage caused by internal pressurization of the keg contents.

10 Claims, 6 Drawing Sheets

SAFETY DEVICE FOR A BEVERAGE CONTAINER VALVE INSET

BACKGROUND OF THE INVENTION

The invention relates to a safety device for a valve inset located in a discharge aperture of a pressurized beverage container, in particular a beer keg, comprising a housing, a rise pipe, a base plate and, an external compression spring resting by one end against the base plate and by another end against a seal. A locking component is pivotally mounted between the external compression spring and the base plate such that during insertion it moves out of the way relative to a dispensing aperture of the pressurized container or keg and in the operational position it engages from behind an inner rim of the dispensing aperture.

Conventional safety devices of the above type are known in a variety of designs. They are used to seal the dispensing aperture of a pressurized beverage container, in particular a beer keg, after it has been filled, and are subsequently connected to a tap when dispensing the beverage. When the beverage containers are readied at the factory, the safety devices are each inserted into a dispensing aperture of each container. As a rule, the component of the beverage container which herein is called for simplicity merely the keg dispensing aperture generally comprises a pipe stub which enters at least partly into the keg and is fitted with an internal thread in the vicinity of the outer upper end so that the safety device, in turn fitted with a corresponding outer thread, can be screwed tightly into the safety device or safety insert. Thereupon the beverage keg undergoes further processing steps, in particular pressure tests for proper sealing, cleaning etc., until finally the beverage keg is filled with a beverage, at another keg location, namely through a separate feed aperture, and then is sealed.

In practice numerous accidents have taken place mostly because of improper handling of the safety device or valve inset in the keg dispensing aperture. If for instance the heretofore widely used conventional valve insets are being unscrewed from the filled or partly filled beverage keg, then the internal pressure in the keg may cause the entire system to fly out at high speed jeopardizing and/or injuring the operator.

Regulations have been issued to prevent such dangers, namely that the valve insets must be fitted with safety devices which always shall preclude the valve inset from being propelled out of the keg if improperly handled. As a result of these regulations, many varied and mostly highly complex designs have been suggested. Illustratively, a safety device used in practice comprises a bayonet slotted plate in the valve inset, the plate in turn being fitted with a hook which in the operational position will act underneath the lower or the inner rim of a pipe stub at the keg dispensing aperture. However, such a design incurs the drawback that the safety device together with its individual components must be inserted while in the disassembled condition because the size of the bayonet plate exceeds the diameter of the keg dispensing aperture or of the pipe stub. Therefore, the bayonet plate must be moved by itself and obliquely through the dispensing aperture inside the pipe stub and thereupon it must be pivoted into the proper position, whereafter the actual assembly of the safety device must be carried out while the bayonet system then locks. With the large-scale handling of the beverage kegs in the beverage industry, such handling is extraordinarily laborious and time-consuming.

British patent document 21 88 040 describes a safety device similar to the one discussed above. In this design the locking component proper is an outwardly projecting hook integral with the bayonet plate. Accordingly, only partial assembly of the safety device may be carried out initially, that is, a partial assembly of the central pipe with a sealing annulus, compression spring and an initially loose bayonet plate. Because of the radial projection of the locking component, the insertion procedure through the dispensing aperture of the cask can be implemented only by keeping the bayonet plate and the central pipe oblique. Thereupon the final assembly of the safety device is carried out by depositing a separate head part with a cylindrical pipe stub comprising L-shaped slots at its inside end which must receive radial projections of the bayonet plate. Only after such procedure is it possible to definitively screw the safety device into the keg dispensing aperture. This design and its assembly is cumbersome and time-consuming, the more so because the compression spring must be compressed when being mounted to the keg in order to make the bayonet plate engage.

A similar safety device is disclosed in WO 91/026 94-A1. Therein the locking component consists of a comparatively long axial tang with an integral ring at its upper end which in turn is held by a compression spring. The lower tang end is bent outward and comprises a bracket which is bent radially outward. Again, the configuration of the locking component entails initial assembly in an oblique central pipe position as well as of the surrounding parts before the housing can be righted, axially inserted and lastly screwed in place.

Finally, German Offenlegungsschrift 38 44 428 discloses anchoring systems for tap pipes in beer kegs. Three circumferentially distributed and axially parallel bars are present on an upper sealing component, angled arms running obliquely upward and outward being linked in a suitable manner to the lower ends of said bars and being affixed through windows in the pipe wall of the head piece. The free ends of these arms point to the inside surface of the vessel neck and thereby the head piece cannot be rotationally loosened from the keg.

Further safety devices are known from the British patent document 2,209,740 and from U.S. Pat. No. 1,003,447.

German patent document 41 14 604 A1 discloses a safety device of the type initially described herein. While this safety device is easily assembled and easily inserted, it was found that the removal from the keg dispensing aperture is practically excessively cumbersome and time-consuming.

SUMMARY OF THE INVENTION

Accordingly, it is the object of the present invention to create a safety device which on one hand can be inserted into the keg dispensing aperture, while in the fully assembled state, by being merely forced into it axially, and being made operative by subsequently screwing tight, and which on the other hand can be removed again as a closed unit by using a special tap.

The problems of conventional devices are solved by the invention in that the locking element is designed as a double-angled piece with an outward tang, an oblique segment and an inside projection or tang. The outward tang rests in a trapezoidal recess in the base plate, and the rise pipe has a conical flare between the pipe's lower smaller diameter portion and its larger diameter upper portion. A conical flare is located a distance, larger than the normal aperture excursion of the rise pipe, away from the projection of the locking component.

Thereby the essential advantage is achieved that when normally operating the valve inset fitted with the safety device using a normal tap, full safety shall be preserved,even in the event of inexpert handling, while on the other hand the removal of a special tap can be carried out very rapidly and simply. Such a special tap, which produces a substantially larger rise pipe excursion than an ordinary tap, is available only at the manufacturer's or at the filling stations, but not in the general market.

DESCRIPTION OF THE PREFERRED EMBODIMENT

Figure 2:
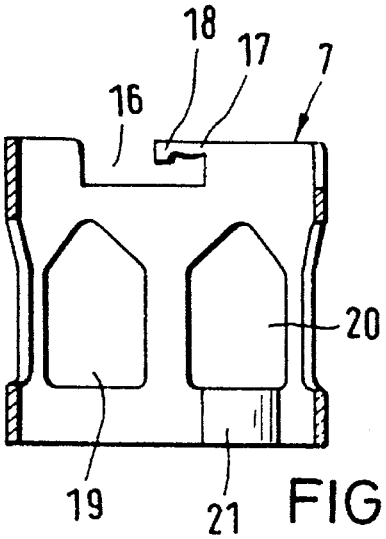
FIG. 2 is an axial cross-sectional view through a bayonet slotted pipe of the safety device.
Figure 1:
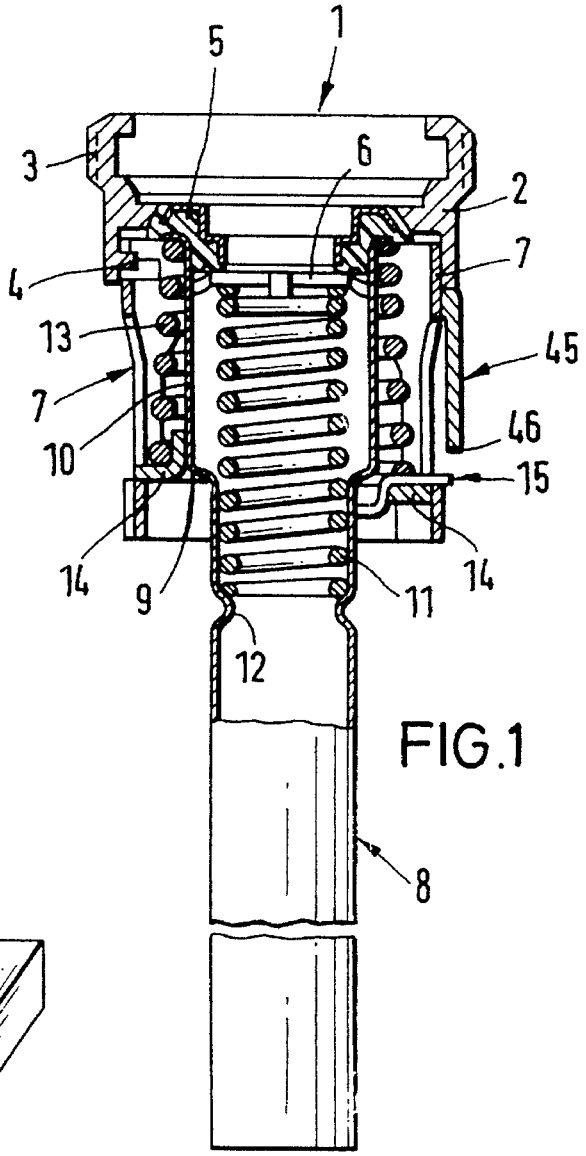
FIG. 1 is a fragmentary axial cross-sectional view of a safety device of the invention.

FIG. 1 illustrates a safety device 1 adapted to be inserted in a dispensing aperture of a pressurized beverage container or cask, in particular a beer keg, with various components being more specifically illustrated in FIGS. 2 through 8. Only part of a pipe stub 45 is shown in FIG. 1 in axial cross-section having a lower rim 46, and the latter is a component of a conventional keg dispensing aperture (omitted for clarity). The safety device or inset device 1 is also known as a "fitting" in the art and comprises a housing composed of a pin ring 2 and a bayonet slotted pipe 7. The pin ring 2 comprises an outer thread 3 and three radially inwardly projecting pins 4 equidistantly spaced along an inner circumference near a lower end of the pin ring 2 with the pins 4 forming a bayonet lock with an upper end (unnumbered) of the bayonet slotted pipe 7. For the latter purpose three circumferentially distributed clearances or slots 16 and horizontal catches 17, each with one catching head 18, are provided at the upper end of the bayonet pipe 7. A seal 5 and a sealing plate 6 are present in the vicinity of the pin ring 2. A rise pipe 8 extending upwardly from a bottom wall of the beverage cask is located centrally in the housing 2, 7. At its upper end, the rise pipe 8 comprises an outwardly flanged rim (unnumbered) held between the seal 5 and an upper end of an external compression spring 13.

The rise pipe 8 includes a conical flare 9 whereby a lower rise pipe portion (unnumbered) has a lesser diameter than an upper larger diameter rise pipe portion 10 within the housing 2, 7. An internal compression spring 11 is housed within the rise pipe 8 and rests by its lower end (unnumbered) against an inwardly directed circumferential rise pipe constriction 12 and by its upper end (unnumbered) against an underside of the (unnumbered) of the sealing plate 6.

The bayonet slotted pipe 7 comprises at its lower part, that is in the direction of the inside end, three circumferentially distributed radial recesses 21 which by their upper edges support a base plate 14 which is simultaneously centered inside the bayonet pipe 7. As is shown particularly in FIGS. 5 through 8, the base plate 14 comprises a planar annulus 27 having an integral base plate guide collar 28. This guide collar 28 encloses the lower end of the upper large diameter rise pipe portion 10. The planar annulus 27 of the base plate 14 is provided with a trapezoidal recess 29. Moreover, the base plate guide collar 28 has an aperture 30 in the vicinity of the trapezoidal recess 29 to allow the passage of a locking element 15.

Figure 3:
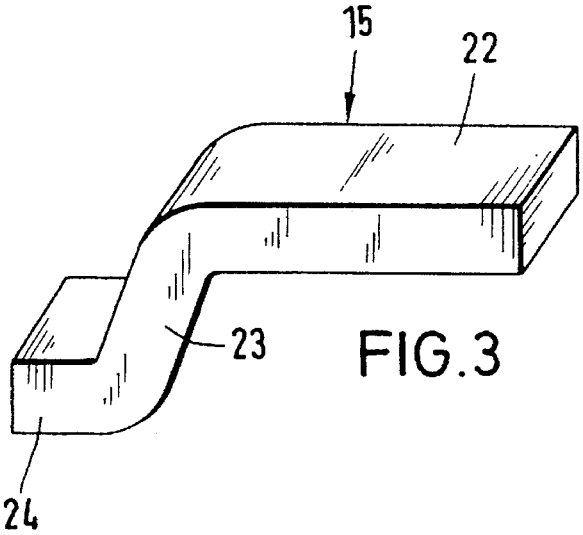
FIG. 3 is an enlarged perspective of a locking element of the safety device.
Figure 4:
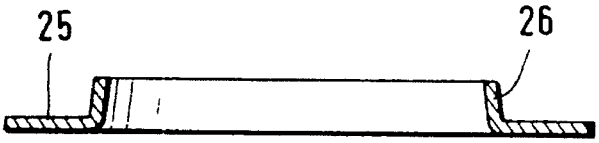
FIG. 4 is an enlarged axial sectional view of a centering disk of the safety device.
Figure 5:
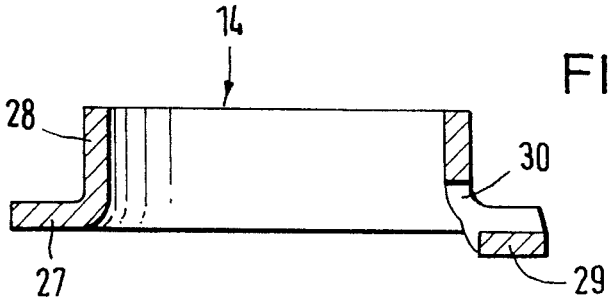
FIG. 5 is an enlarged axial sectional view of a base plate of the safety device.
Figure 8:
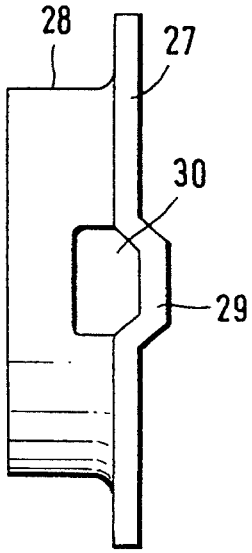
FIG. 8 is a side view looking from right-to-left in FIG. 6.
Figure 6:
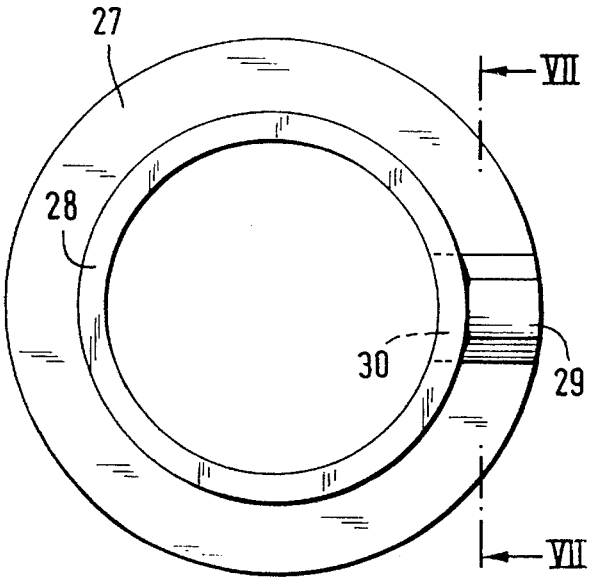
FIG. 6 is a top view of the base plate of FIG. 5.
Figure 7:
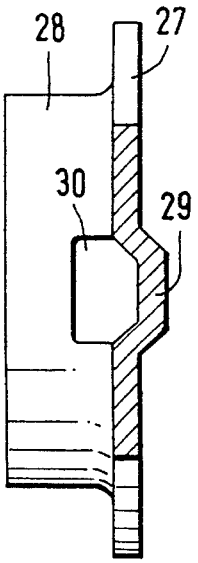
FIG. 7 is a cross-sectional view taken along line VII—VII of FIG. 6.

As is shown in FIG. 3, the locking element 15 is a double angled piece defined by an externally projecting locking element tang 22, an oblique segment 23 and an inner projection 24. The tang 22 of the locking element 15 rests in the trapezoidal recess 29 of the base plate 14 and is simultaneously secured and guided therein. The depth of the recess 29 corresponds to the height, i.e., the thickness, of the projecting locking element tang 22, whereby said recess is held, over the entire circumference, by the force from the external compression spring 13 tightly against the base plate 14 and the locking element 15, as a result of which the external compression spring pressure keeps file locking element 19 in the outwardly pivoted operational position or locking position, relative to the lower rim 46 of the keg dispensing stub or pipe stub 45.

In relation to the closed position of the valve inset or safety device 1, the conical flare 9 of the rise pipe 8 is located at a distance greater than the normal opening excursion of the rise pipe 8 away from the upper surface of the projection 24 of the locking element 15.

The latter construction results in the following operation.

When the safety device 1 is installed in the keg dispensing aperture, the locking element 15 is permanently kept in the locked position by the pressure of the external compression spring 13. Furthermore, the valve inset 1 is sealed at the upper end. If a conventional beverage drawing tap is mounted conventionally relative to the valve inset 1 and then is actuated, the seal 5 together with the sealing plate 6 and the rise pipe 8 will be pressed downward against the action of the external compression spring 13. The excursion generated by the normal tap however is less than the distance between the conical flare 9 and the projection 24 of the locking element 15, as a result of which the inner top edge of the projection 24 inevitably makes contact with the inside rim of the conical flare 9. If, instead, a special tap is mounted, it generates an excursion so large that the conical flare 9 impacts the projection 24, whereby the inner upper edge of the projection 24 slides along the conical flare 9, while at the same time the locking element 15 pivots, as far as the lower zone of the upper rise pipe portion 10. In this manner the locking element 15 is constrained to pivot counterclockwise inward in FIG. 1 until the outer edge of the locking element 15 has reached the inside of the cask dispensing aperture, whereby henceforth the entire safety device 1 may be screwed out in simple manner.

As a rule, a single locking element 15 as described shall suffice for the above safety device 1 of the invention. However, to amplify safety, several, preferably three, locking elements 15 may be mounted in equidistant circumferential manner and in corresponding trapezoidal recesses.

The bayonet pipe 7 comprises several circumferential transmission aperture 19, 20 which on one hand allow transmitting the externally supplied pressurizing gas when the valve inset 1 is opened and which on the other hand facilitate cleaning the safety device 1.

Depending upon the design of the safety device 1, the rise pipe 8 may be guided additionally by inserting at an appropriate place a centering disk 25 with a centering collar 26, for instance between the lower end of the external compression spring 13 and the base plate 14.

Figure 9:
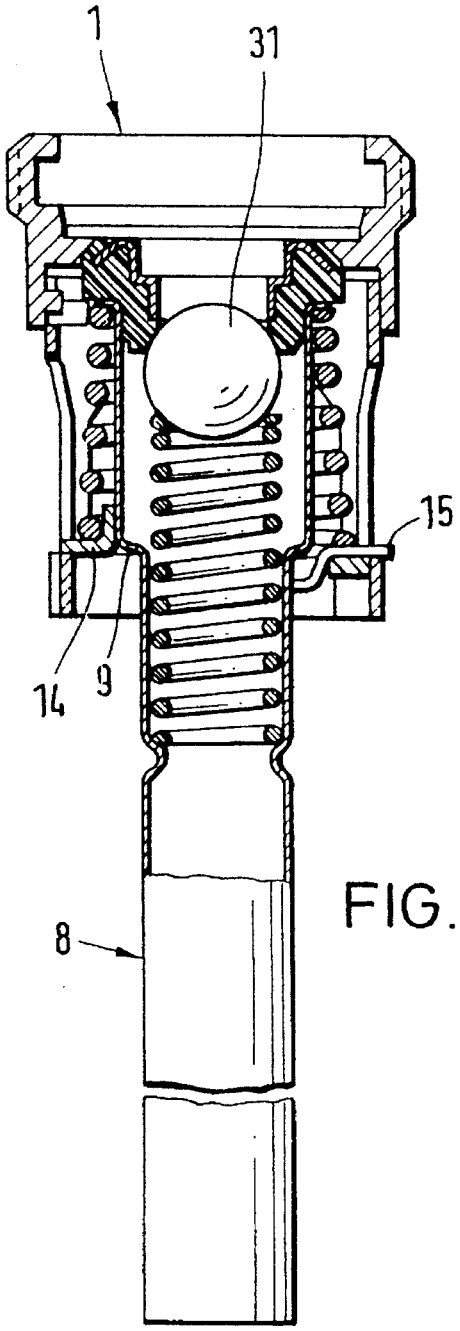
FIG. 9 is an axial cross-sectional view of a safety device of another embodiment of the invention.
Figure 10:
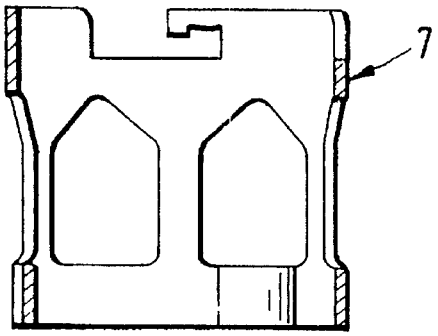
FIG. 10 is an axial cross-sectional view through a bayonet slotted pipe corresponding to that of FIG. 2 which is used in the safety device of FIG. 9.
Figure 11:
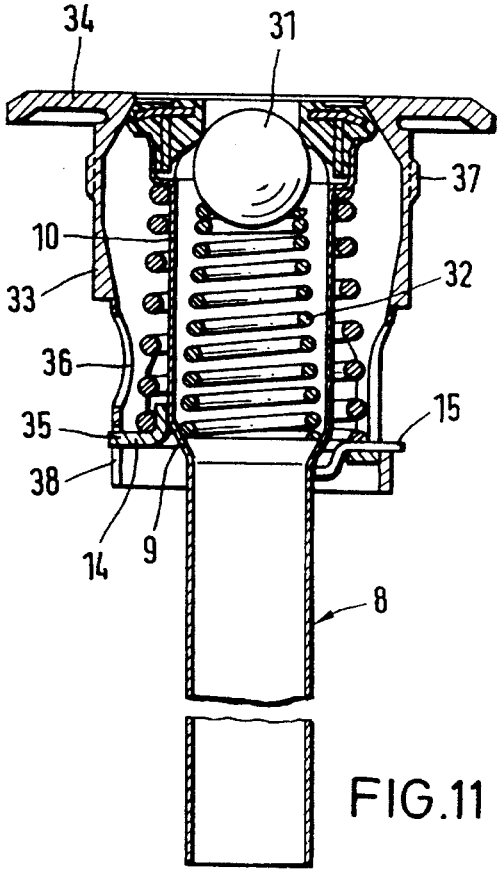
FIG. 11 is an axial cross-sectional view of another safety device of the invention.
Figure 12:
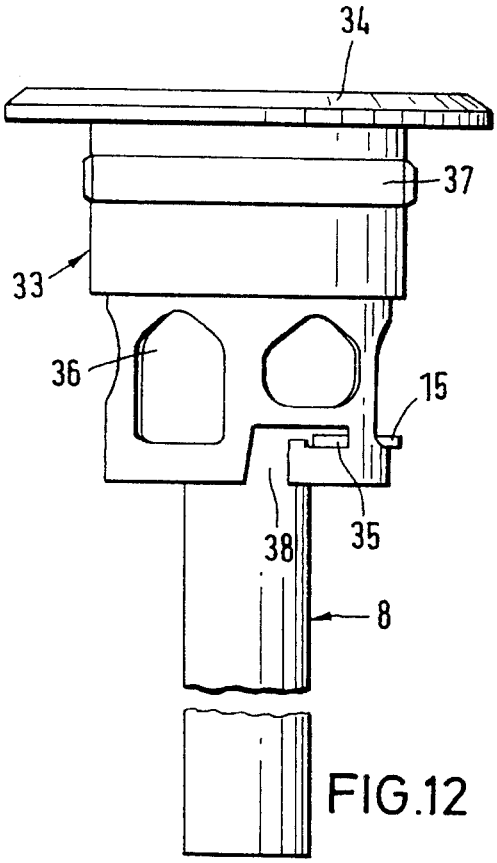
FIG. 12 is a front elevational view of the safety device of FIG. 11.
Figure 13:
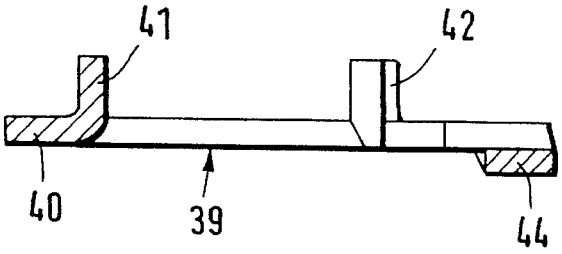
FIG. 13 is an axial cross-sectional view of another base plate of this invention.
Figure 16:
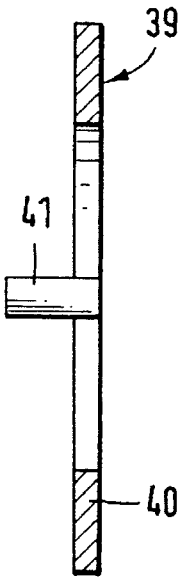
FIG. 16 is an axial cross-sectional view of the base plate of FIG. 13.
Figure 14:
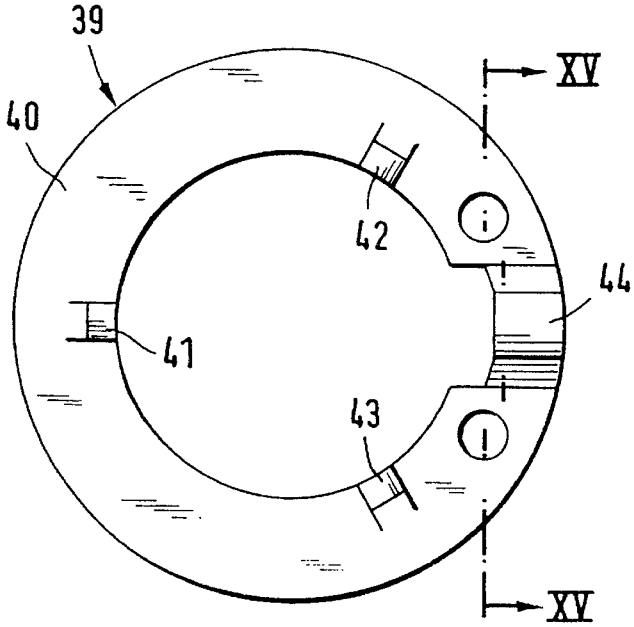
FIG. 14 is a top plan view of the base plate of FIG. 13.
Figure 15:
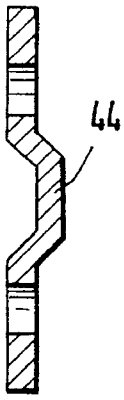
FIG. 15 is a cross-sectional view taken along line XV—XV of FIG. 14.
Figure 17:
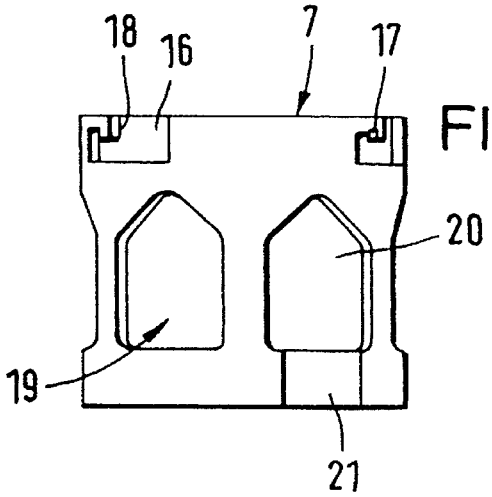
FIG. 17 is a side elevational view of the bayonet slotted pipe of FIG. 2.
Figure 18:
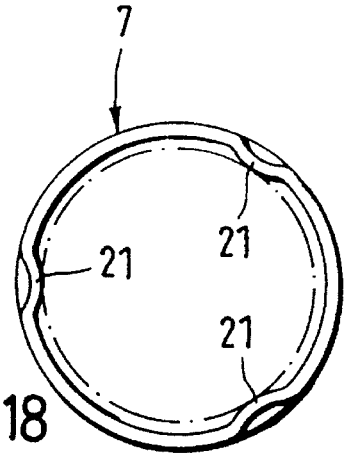
FIG. 18 is a top plan view of the bayonet slotted pipe of FIG. 17.
Figure 19:
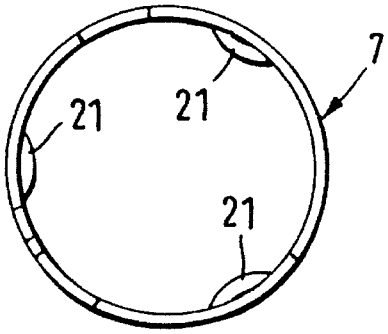
FIG. 19 is a top plan view of the bayonet slotted pipe of FIG. 17.
Figure 20:
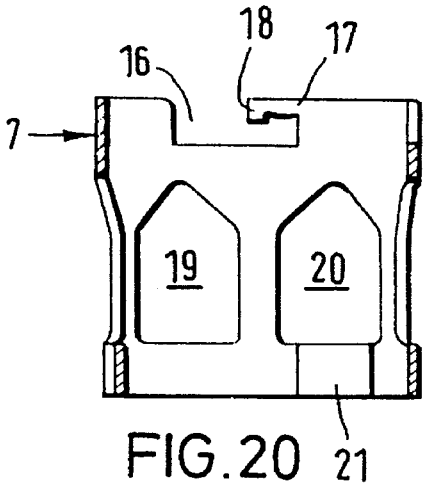
FIG. 20 is an axial cross-sectional view of the bayonet slotted pipe of FIG. 17.
Figure 21:
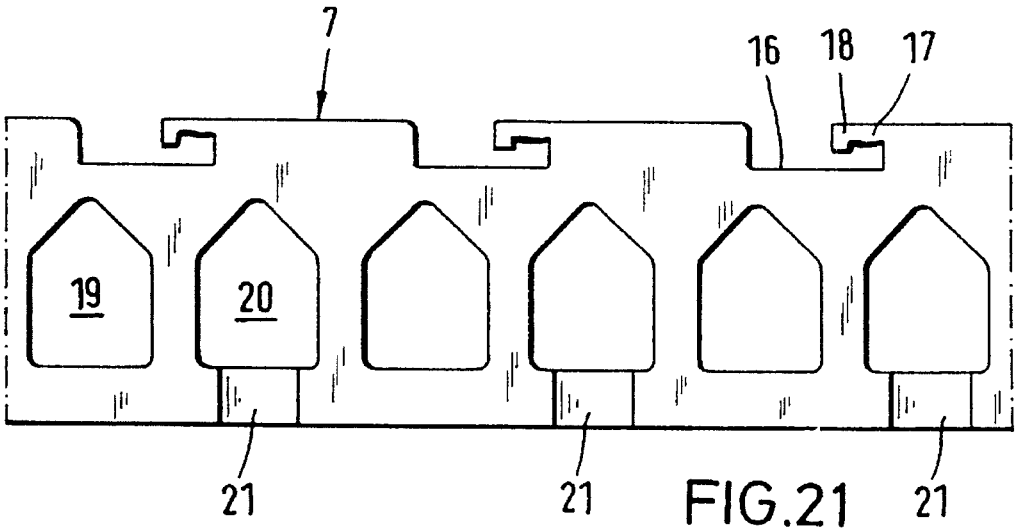
FIG. 21 is a geometric development of the bayonet slotted pipe of FIG. 17.

FIGS. 9 through 16 illustrate the applicability of the structure of the invention to safety devices of other designs. For instance, FIG. 9 shows the use, known per se, of a sealing ball 31 in lieu of the sealing plate 6 of FIG. 1. FIGS. 11 and 12 show the mounting of an internal compression spring 32 inside the rise pipe 8, namely, inside the upper, larger diameter rise pipe portion 10, in such manner that it rests on one hand against the inside surface of the conical flare 9 and on the other hand against the sealing ball 31. Advantageously, in this design, the internal compression spring 32 tapers conically upwardly between the inside surface of the conical flare 9 and the sealing ball 31. In a variation from the design of FIG. 1, a housing 33 in this embodiment is integral with a head plate 34. Moreover, a bayonet lock 35 is present at lower end of the housing 33 between the housing 33 and the base plate 14. For the latter purpose, circumferential angular clearances 38 are present at a lower edge of the housing 33 so that the base plate 14 forms a bayonet lock by means of its outward projections (unnumbered). Similarly to the bayonet pipe 7, the housing 33 includes transmission apertures 36. Also, an external thread 37 is present on the housing 33.

FIGS. 13 through 16 illustrate a simplified and more lightweight embodiment of a base plate 39 composed of an annular panel or ring 40 with the three upward and integral guide tangs 41, 42 and 43, and at least one trapezoidal recess 44 which corresponds to the recess 29 of FIGS. 5 through 8. Although a preferred embodiment of the invention has been specifically illustrated and described herein, it is to be understood that minor variations may be made in the apparatus without departing from the spirit and scope of the invention, as defined the appended claims.

We claim:

1. In a safety device for a valve inset in a dispensing aperture of a pressurized container including a housing (2, 7), a rise pipe (8), a base plate (14), an external compression spring (13) resting at one end against the base plate (14) and at an opposite end against a seal (5), at least one locking element (15) pivotably mounted between the external compression spring (13) and the base plate (14) such that it moves out of the way relative to a keg dispensing aperture (45) during the axially directed insertion procedure, the improvement comprising the locking element (15) being formed as a double angled piece with an outwardly projecting tang (22), an oblique segment (23) and an inward projection (24); the tang (22) rests in a trapezoidal recess (29) of the base plate (14), the rise pipe (8) includes a conical flare (9) between a lower rise pipe portion of a lesser diameter and an upper larger diameter rise pipe portion (10) in the housing (2, 7), and the conical flare (9) is directed away from the projection (24) of the locking element (15) by a distance larger than a normal opening excursion of the rise pipe (8).

2. The improvement in a safety device as defined in claim 1 wherein the housing (2, 7) comprises a pin ring (2) and a bayonet slotted pipe (7) which interlock and unlock.

3. The improvement in a safety device as defined in claim 2 wherein the bayonet pipe (7) comprises circumferentially distributed recesses (21 ) supporting the base plate (14) by upper edges thereof.

4. The improvement in a safety device as defined in claim 3 wherein the base plate (14) includes an annular plate (27) with an integral guide collar (28), and the guide collar (28) encloses a lower end of the upper rise pipe portion (10).

5. The improvement in a safety device as defined in claim 4 wherein the guide collar (28) comprises a transmission aperture (30) for the locking element (15) in the vicinity of a trapezoidal recess (29) of said annular plate (27).

6. The improvement in a safety device as defined in claim 1 wherein the housing (2, 7) includes a bayonet pipe (7) having several circumferential distributed transmission apertures (19, 20).

7. The improvement in a safety device as defined in claim 1 wherein an internal compression spring (11, 32) is mounted inside the rise pipe (8) and rests at one end against one of the inside surfaces of the conical flare (9) and against a circumferential constriction (12) and at an opposite end against one of a sealing plate (6) and a sealing ball (31).

8. The improvement in a safety device as defined in claim 7 wherein the internal compression spring (32) tapers conically upward between an inside surface of the conical flare (9) and the sealing ball (31).

9. The improvement in a safety device as defined in claim 1 wherein the base plate (39) is composed of an annular plate (40) with a trapezoidal recess (44) and three integral guide tangs (41, 42, 43).

10. The improvement in a safety device as defined in claim 1 including a centering disk (25) with an integral centering collar (26) inserted between a lower end of the external compression spring (13) and the base plate (14).

* * * * *